US006844301B2

(12) United States Patent
Field et al.

(10) Patent No.: US 6,844,301 B2
(45) Date of Patent: Jan. 18, 2005

(54) LUBRICATING COMPOSITIONS

(75) Inventors: Ian Peter Field, Abingdon (GB); Etienne Marc Tamigniau, Tilly (BE)

(73) Assignees: Infineum USA LP, Linden, NJ (US); Fina Research S.A., Seneffe (BE)

( * ) Notice: Subject to any disclaimer, the term of this patent is extended or adjusted under 35 U.S.C. 154(b) by 0 days.

(21) Appl. No.: 10/235,466

(22) Filed: Sep. 5, 2002

(65) Prior Publication Data

US 2003/0027730 A1 Feb. 6, 2003

Related U.S. Application Data

(63) Continuation of application No. 09/539,220, filed on Mar. 30, 2000, now abandoned, which is a continuation of application No. PCT/GB98/02947, filed on Oct. 3, 1997.

(30) Foreign Application Priority Data

Mar. 1, 1997 (EP) ..... 97307845

(51) Int. Cl.[7] ..... C10M 129/74

(52) U.S. Cl. ..... 508/485; 508/495; 508/562; 508/584; 508/591

(58) Field of Search ..... 508/485

(56) References Cited

U.S. PATENT DOCUMENTS

| | | | | | |
|---|---|---|---|---|---|
| 3,542,678 | A | | 11/1970 | Bork | 508/500 |
| 3,933,659 | A | | 1/1976 | Lyle et al. | 508/294 |
| 4,010,107 | A | | 3/1977 | Koch et al. | 508/439 |
| 4,053,491 | A | | 10/1977 | Koch et al. | 554/227 |
| 4,119,551 | A | | 10/1978 | Yaffe | 508/439 |
| 4,157,971 | A | | 6/1979 | Yaffe et al. | 508/439 |
| 4,175,045 | A | | 11/1979 | Timony | 508/485 |
| 4,234,497 | A | | 11/1980 | Honig | 554/172 |
| 4,440,660 | A | | 4/1984 | Van Rijs et al. | 508/485 |
| 4,477,383 | A | | 10/1984 | Beimesch et al. | 554/227 |
| 4,826,633 | A | | 5/1989 | Carr et al. | 508/485 |
| 4,994,196 | A | * | 2/1991 | Kagaya et al. | 508/485 |
| 5,503,761 | A | * | 4/1996 | Ashcraft, Jr. et al. | 508/485 |
| 5,674,822 | A | * | 10/1997 | Schlosberg et al. | 508/485 |
| 5,681,800 | A | * | 10/1997 | Duncan et al. | 508/485 |
| 5,698,502 | A | * | 12/1997 | Pafford et al. | 508/485 |
| 5,744,434 | A | * | 4/1998 | Schlosberg et al. | 508/485 |
| 5,880,075 | A | * | 3/1999 | Hartley et al. | 508/501 |
| 5,895,778 | A | | 4/1999 | McHenry et al. | 508/495 |
| 5,942,474 | A | * | 8/1999 | Tiffany et al. | 508/485 |
| 6,402,983 | B1 | * | 6/2002 | Abe et al. | 252/77 |
| 6,605,573 | B1 | * | 8/2003 | Koganei et al. | 508/376 |
| 6,649,576 | B2 | * | 11/2003 | Bell et al. | 508/481 |

FOREIGN PATENT DOCUMENTS

| | | |
|---|---|---|
| EP | 0066935 | 12/1982 |
| EP | 82200690.4 | 12/1982 |
| EP | 0578435 | 1/1994 |
| EP | 93305125.2 | 1/1994 |
| EP | 0646638 | 4/1995 |
| EP | 94306966.6 | 4/1995 |
| EP | 0696797 | 2/1996 |
| EP | 95305170.3 | 2/1996 |
| EP | 0747467 | 12/1996 |
| EP | 96304157.9 | 12/1996 |
| FR | 1.598.877 | 8/1970 |
| WO | PCT/US93/03381 | 10/1993 |
| WO | 9321288 | 10/1993 |
| WO | PCT/US96/11729 | 2/1997 |

* cited by examiner

*Primary Examiner*—Ellen M. McAvoy
(74) *Attorney, Agent, or Firm*—Stout, Uxa, Buyan & Mullins, LLP; Frank J. Uxa; Greg S. Hollrigel

(57) ABSTRACT

A synthetic ester-containing lubricant with good soot-handling and, with friction modifier, viscosity modifier and antioxidant present, improved engine performance and cleanliness.

14 Claims, No Drawings

LUBRICATING COMPOSITIONS

This application is a continuation of application Ser. No. 09/539,220, filed Mar. 30, 2000, now abandoned, which is a continuation of International Application Serial No. PCT/GB98/02947, filed Oct. 1, 1998, which claims priority to European Application Serial No. EP 97 307 845.4, filed Oct. 3, 1997, the contents of which in their entireties are hereby incorporated by reference.

This invention relates to lubricating compositions, more especially to compositions suitable for use in piston engine, especially diesel (compression-ignited) engine, crankcase lubrication. The invention also relates to the use of certain components to give improved properties in certain respects.

There is an increasing demand for improvement in efficiency and useful life of oil-based lubricants. A factor substantially shortening the useful life of a lubricating composition is oxidation. This results in the formation of acids, which tend to corrode engine parts, and in an unwanted viscosity increase, which reduces the utility of the composition as a lubricant.

A primary purpose of a lubricant is to reduce the friction between moving parts; in a crankcase lubricant friction reduction results in lower engine wear and improved engine efficiency.

A further purpose of a crankcase lubricant is to maintain in suspension any by-products of combustion that find their way into the crankcase, preventing the formation of sludge and deposits that would otherwise foul the engine.

There remains a need for improvement in all these functions and properties of lubricant compositions.

The present invention provides the use, to improve the ability of a lubricant composition to retain particulate combustion products in suspension, of an ester of a carboxylic acid having at most 30 carbon atoms and an alcohol, the ester having a molecular weight within the range of from 400 to 5000. More especially, the invention provides the use of such an ester to improve the soot handling characteristics of the composition.

Mixtures of esters may be used provided their weight average molecular weight is or their characteristics are within the desired ranges. In many embodiments this may result from the use of an acid and/or alcohol component of a product derived from a natural (animal or vegetable) source, or from petroleum base stock, in which case the component will be a mixture of materials with a narrow range of molecular weights. In other embodiments, the mixture may be of materials of widely differing molecular weights as when, for example, a small portion of lower or higher ester is added to adjust the properties, e.g., the viscosity, of the ester component or of the total lubricant composition.

Advantageously, the molecular weight of the ester or the weight average molecular weight of the ester mixture is at most 2000, more advantageously within the range of from 400 to 1000, preferably from 450 to 1000 and most preferably from 500 to 750.

The ester is advantageously obtainable by reaction of one or more carboxylic acids and one or more alcohols, more especially by reaction of a polycarboxylic acid and a monohydric alcohol or, preferably, a polyhydric alcohol and a monocarboxylic acid. Advantageously, the ester is an aliphatic, preferably a saturated aliphatic, ester.

The alcohol advantageously contains from 2 to 8, preferably from 3 to 6, and most preferably 3 or 4, esterifiable hydroxyl groups, and advantageously contains from 2 to 10, preferably 5 or 6, carbon atoms. The polyol is advantageously trimethylolpropane, pentaerythritol, neopentyl glycol, or dimethylolpropane. The polyol may contain one or more, advantageously 1 or 2, ether functions; examples of such compounds are oligomers of the above-mentioned polyols, e.g., di- or tri-pentaerythritol. Cycloaliphatic polyols may be used but aliphatic polyols are presently preferred, especially trimethylolpropane. The acid advantageously contains at most 24, more advantageously from 6 to 18, carbon atoms, including the carboxyl carbon atom, and preferably from 8 to 12, most preferably from 8 to 10, carbon atoms, and, as indicated above, advantageously contains a single carboxylic group.

As acids there are advantageously used aliphatic acids, preferably saturated aliphatic acids. As examples there may be mentioned hexanoic, heptanoic, octanoic, nonanoic, decanoic, dodecanoic, and stearic acids. The acid may be linear or branched; mixtures of acids may be preferred primarily for reasons of availability. In embodiments in which a polyol is employed, it may be esterified with a mixture of mono- and poly- carboxylic acids, the latter advantageously in a minor proportion, to give a so-called complex ester. Similarly, a polycarboxylic acid may be used with a mixture of mono- and poly-ols.

Advantageously, the ester is substantially free from unreacted alcohol and acid moieties; advantageously the acid number of the ester is at most 5, preferably at most 1, mg KOH/g.

Advantageously, the pour point of the ester, as measured by ASTM D97, is at most −15° C., preferably at most −21° C. Its viscosity at 100° C. is advantageously within the range of from 3 to 12, and preferably within the range of from 4 to 8, $mm^2$/sec or cSt. Its viscosity index is advantageously at least 120, preferably from 130 to 160, as measured by ASTM D2270.

The invention accordingly also provides the use, to improve the ability of a lubricant composition to retain particulate combustion products, especially soot, in suspension, of an ester having an ASTM D97 pour point of at most −15° C., a viscosity at 100° C. within the range of from 3 to 12 $mm^2$/sec, and an ASTM D2270 viscosity index of at least 120. Advantageously the ester has an acid number of at most 5 mg KOH/g, and preferably its chemical constitution is as defined and described above.

A presently preferred ester is trimethylolpropane esterified by mixed $C_8$ to $C_{10}$ alkanoic acids, such as the ester commercially available from FINA Chemicals as Radialube 7368. Radialube is a trade mark.

As will be discussed in more detail below, a typical lubricant composition will contain, in addition to a natural and/or synthetic base stock, various additives among which may be mentioned detergents, dispersants, antioxidants, antiwear agents, corrosion inhibitors, friction modifiers, rust inhibitors, pour point depressants, viscosity modifiers and antifoams. Two or more materials in each functional category may be used, and a given material may be effective in more than one functional category.

It has been found that the friction-reducing properties of the lubricant of the present invention may be improved by the incorporation of an amine-based friction modifier.

The invention accordingly further provides a lubricant composition comprising an ester as defined above and an amine-based friction modifier, the composition containing from 5 to 50% by weight of the ester, based on the total weight of the composition.

The invention also further provides the use, to improve the friction-reducing properties of a lubricant composition, of an ester as defined above and an amine-based friction modifier.

It has also been found that the oxidation stability and deposit control of the ester-containing lubricant of the present invention may be improved by the incorporation of a viscosity modifier, more especially an alkenyl arene/diene copolymer viscosity modifier, otherwise known as a viscosity index improver, and an antioxidant, more especially a hindered phenol antioxidant.

The invention still further provides a lubricant composition comprising an ester as defined, an alkylene arene/diene copolymer viscosity modifier, and a hindered phenol antioxidant, the composition containing from 5 to 50% by weight of the ester, based on the total weight of the composition.

The invention also provides the use, to improve the control of piston deposits in a diesel (compression-ignited) engine, of a lubricant composition containing an ester as defined, a viscosity modifier as defined and a hindered phenol antioxidant.

It will be appreciated that advantageously the lubricant composition will contain both the friction-reducing and the deposit controlling components.

In all embodiments of the invention, the ester is advantageously present in a proportion of from 5% to 50%, preferably from 10% to 40%, and most preferably from 15% to 30%, by weight of the total composition.

The base stock may comprise, in addition to the ester provided according to the invention, other synthetic base stocks, including esters other than those as defined above; poly-α-olefins, polybutenes, alkyl benzenes, alkylated naphthalenes, esters of phosphoric acids and polysilicone oils, as well as natural base stocks.

Natural base stocks, within Group I, II, or III of the API EOLCS 1509 definition, include mineral lubricating oils which may vary widely as to their crude source, for example, as to whether they are paraffinic, naphthenic, mixed, or paraffinic-naphthenic, as well as to the method used in their production, for example, their distillation range and whether they are straight run or cracked, hydrofined, or solvent extracted.

An API Group III base stock, for example a hydrocracked or hydroisomerized base stock, is preferred, a hydroisomerized base stock being especially preferred. The base stock or base stocks, other than the ester provided by the invention, together with any of the additives present, make up the balance of the composition.

The invention is especially applicable to compositions which contain, in addition to the ester as defined above, an API Group III base stock, especially a hydroisomerized base stock, and a detergent in a proportion that gives an ash content of at least 1.5%, advantageously in the range of from 1.5% to 7%, and and preferably from 1.5% to 3%, most preferably from 1.8% to 3%, by weight.

The lubricating oil base stock mixture conveniently has a viscosity of 2.5 to 12 cSt, or $mm^2/s$, and preferably 3.5 to 9 cSt., or $mm^2/s$, at 100° C., the actual value depending on the lubricant grade being manufactured.

As the amine-based friction modifier, there may be mentioned more especially a tertiary amine. Examples of suitable tertiary amines are given in International Applications Nos. WO 93/21288 and WO 97/04050, the disclosures of which are incorporated by reference herein. Advantageously there is used a compound of the formula

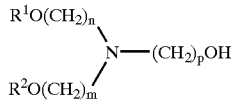

wherein $R^1$ represents an alkyl group, $R^2$ represents hydrogen or an alkyl group, and m, n, and p independently represent an integer within the range of from 1 to 4. Advantageously, the alkyl group(s) contain(s) from 12 to 20 carbon atoms. Advantageously m and p represent 2, n represents 2 or 3, and $R^2$ represents hydrogen. Especially preferred friction modifiers are N-(2-hydroxyethyl) -N-(2-tallowoxyethyl)-2-aminoethanol, and N-(2-hydroxyethyl)-N-(3-tallowoxypropyl)-2-aminoethanol, wherein tallow represents a natural product comprising predominantly $C_{16}$ and $C_{18}$ alkyl groups.

The friction modifier is advantageously present in a proportion of from 0.025% to 1.0%, preferably from 0.05% to 0.25%, more preferably from 0.075% to 0.15% , by weight of the total composition.

Viscosity modifiers impart high and low temperature operability to a lubricating oil and permit it to remain shear stable at elevated temperatures and also exhibit acceptable viscosity or fluidity at low temperatures.

As the alkenyl arene/diene copolymer viscosity modifier, there may be mentioned, more especially, hydrogenated copolymers, in which advantageously at least 80%, preferably from 90 to 98%, of the residual unsaturation has been removed. As preferred examples of the copolymers there may be mentioned block copolymers, for example di- and tri-block copolymers. As examples of such copolymers there may be mentioned styrene, including alkyl-substituted styrene, and isoprene copolymers. Other conjugated dienes, e.g., butadiene, may also or instead be used. A typical weight average molecular weight range for the polymer is from 10,000 to 100,000, preferably from 70,000 to 100,000. As further examples of suitable copolymers, there may be mentioned star copolymers, which typically have a core of an alkenyl arene polymer, e.g., of divinyl benzene, and a number of pendant arms, typically 4 to 25, more especially 12 to 16, arms, provided by, for example, a diene polymer, e.g., of isoprene, advantageously hydrogenated, each arm typically having a molecular weight of from 30,000 to 50,000, and the star polymer typically having a molecular weight of from 500,000 to 620,000. The free ends of the arms may carry functional groups.

Advantageously, the copolymer is a hydrogenated styrene/diene, preferably styrene/isoprene block copolymer.

The viscosity modifier is advantageously present in a proportion of from 0.05% to 2%, preferably from 0.1% to 1.5%, more preferably from 0.75% to 1.25%, by weight, based on the total composition.

Antioxidants reduce the tendency of mineral oils to deteriorate in service, evidence of such deterioration being, for example, the production of varnish-like deposits on metal surfaces and of sludge, and viscosity increase.

As hindered phenol antioxidant, there is advantageously used one of the formula

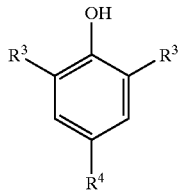

wherein $R^3$ represents a tertiary butyl group, and $R^4$ represents alkyl, optionally interrupted by a hetero atom, preferably sulphur, $CH_2$-aryl, aryl, or $(CH_2)_nCOOR^5$, in which n represents 1 to 4 and $R^5$ represents an alkyl group. When $R^4$ represents an alkyl group it advantageously contains from 6 to 20 carbon atoms. Advantageously n represents 2, and advantageously $R^5$ represents an alkyl group containing from 6 to 10, preferably 7 to 9, carbon atoms. A preferred antioxidant is Irganox (TM) L135, in which $R^4$ represents $CH_2CH_2COOR^5$, $R^5$ being a mixture of $C_8$ alkyl groups. Other suitable antioxidants include hindered bis-phenols, many of which are known and commonly used in the art.

The proportion of hindered phenolic antioxidant will depend largely on its potency. In general, however, it is advantageously present in a proportion of at least 0.25%, more advantageously from 0.5% to 5%, preferably from 1.0% to 4%, and most preferably from 15% to 3.5%, by weight based on the total weight of the composition.

The lubricant compositions of the invention are especially suitable for use as compression-ignited (diesel) engine crankcase lubricants, for example automobile and truck engines, as well as marine and railroad diesel engines, and the invention also provides a process for lubricating such an engine which comprises supplying to the engine a lubricant according to the invention and operating the engine.

In addition to the additives provided in accordance with the invention, the lubricant composition may comprise one or more of the following components:

Suitable viscosity modifiers, in addition to one provided in accordance with the invention, are generally high molecular weight hydrocarbon polymers or polyesters, and viscosity index improver dispersants, which function as dispersants as well as viscosity index improvers. Oil-soluble viscosity modifying polymers generally have weight average molecular weights of from about 10,000 to 1,000,000, preferably 20,000 to 500,000, as determined by gel permeation chromatography or light scattering methods.

Corrosion inhibitors reduce the degradation of metallic parts contacted by the lubricating oil composition. Thiadiazoles, for example those disclosed in U.S. Pat. Nos. 2,719,125, 2,719,126 and 3,087,932, are examples of corrosion inhibitors for lubricating oils. A preferred thiadiazole is bis-2,5-(nonyl disulphide)-1,3,4-thiadiazole.

Suitable antioxidants, in addition to one provided in accordance with the invention, include alkaline earth metal salts of alkyl-phenolthioesters; diphenylamines; phenylnaphthylamines; and phosphosulphurized or sulphurized hydrocarbons.

Friction modifiers, in addition to one provided in accordance with the invention, and fuel economy agents which are compatible with the other ingredients of the final oil may also be included. Examples of such materials are glyceryl monoesters of higher fatty acids, dithiocarbamates, especially the molybdenum salts, and oxazoline compounds.

Dispersants maintain oil-insoluble substances, resulting from oxidation during use, in suspension in the fluid, thus preventing sludge flocculation and precipitation or deposition on metal parts. So-called ashless dispersants are organic materials which form substantially no ash on combustion, in contrast to metal-containing (and thus ash-forming) detergents. Suitable dispersants include, for example, derivatives of long chain hydrocarbon-substituted carboxylic acids in which the hydrocarbon groups contain 50 to 400 carbon atoms, examples of such derivatives being derivatives of high molecular weight hydrocarbyl-substituted succinic acid. Such hydrocarbon-substituted carboxylic acids may be reacted with, for example, a nitrogen-containing compound, advantageously a polyalkylene polyamine, or with an ester. Particularly preferred dispersants are the reaction products of polyalkylene amines with alkenyl succinic anhydrides. Examples of specifications disclosing dispersants of the last-mentioned type are U.S. Specifications Nos. 3,202,678, 3,154,560, 3,172,892, 3,024,195, 3,024,237, 3,219,666, 3,216,936 and Belgian Specification No. 662875.

Other suitable dispersants are the macrocyclic dispersants disclosed, for example, in U.S. Pat. No. 4,637,886, and aminated and optionally borated functionalized olefin polymers with at least 30% terminal vinylidene unsaturation, disclosed in WO-94/13709.

As indicated above, a viscosity index improver dispersant functions both as a viscosity index improver and as a dispersant. Examples of viscosity index improver dispersants suitable for use in lubricating compositions include reaction products of amines, for example polyamines, with a hydrocarbyl-substituted mono- or dicarboxylic acid in which the hydrocarbyl substituent comprises a chain of sufficient length to impart viscosity index improving properties to the compounds.

Examples of dispersants and viscosity index improver dispersants may be found in European Patent Specification No. 24146 B.

Detergents and metal rust inhibitors include the metal salts, which may be overbased, of sulphonic acids, alkyl phenols, sulphurized alkyl phenols, alkyl salicylates, naphthenates, and other oil-soluble mono- and dicarboxylic acids. Overbased metal sulphonates wherein the metal is selected from alkaline earth metals and magnesium are particularly suitable for use as detergents. Representative examples of detergents/rust inhibitors, and their methods of preparation, are given in European Specification No. 208 560 A.

Antiwear agents, as their name implies, reduce wear of metal parts. Metal, especially zinc, dihydrocarbyl dithiophosphates (ZDDPs) are very widely used as antiwear agents. Especially preferred ZDDPs for use in oil-based compositions are those of the formula $Zn[SP(S)(OR^1)(OR^2]_2$ wherein $R^1$ and R2 are independently alkyl or aralkyl groups, advantageously containing from 1 to 18, and preferably 2 to 12, carbon atoms. If a material free from phosphorus is required, there may be used, for example a dithiocarbamate, for example, those described in U.S. Pat. Nos. 4,758,362 and 4,997,969.

Pour point depressants, otherwise known as lube oil flow improvers, lower the temperature at which the fluid will flow or can be poured. Such additives include copolymers of ethylene and an α-olefin or unsaturated ester, polymethacrylates, and succinic acid-olefin copolymers.

Foam control may be provided by an antifoam of the polysiloxane type, for example, silicone oil or polydimethyl siloxane.

Some of the above-mentioned additives provide a multiplicity of effects; thus for example, a single additive may act as a dispersant-oxidation inhibitor.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | Mass % a.i.* (Broad) | Mass % a.i.* (Preferred) |
|---|---|---|
| Viscosity Modifier | 0.01–6 | 0.01–4 |
| Corrosion Inhibitor | 0.01–5 | 0.01–1.5 |
| Oxidation Inhibitor | 0.01–6 | 0.01–4 |
| Friction Modifier | 0.01–5 | 0.01–1.5 |

-continued

| Additive | Mass % a.i.* (Broad) | Mass % a.i.* (Preferred) |
|---|---|---|
| Dispersant | 0.1–20 | 0.1–8 |
| Detergents/rust inhibitors+ | 0.01–6 | 0.01–5 |
| Anti-wear Agent | 0.01–6 | 0.01–4 |
| Pour Point Depressant | 0.01–5 | 0.01–1.5 |
| Anti-Foaming Agent | 0.001–3 | 0.001–0.15 |
| Mineral or Synthetic Oil Base | Balance | Balance |

*Mass % active ingredient based on the final oil, excluding the additives provided according to the invention, but may be reduced from the values given if the invention provides an additive having the same function.
+Relatively larger proportions, for example at least 10 mass %, are normally used for marine applications.

When a plurality of additives is employed it may be desirable, although not essential, to prepare one or more additive concentrates comprising the additives (a concentrate sometimes being referred to as an additive package) whereby several additives can be added simultaneously to the base oil to form the lubricating oil composition. Dissolution of the additive concentrate(s) into the lubricating oil may be facilitated by solvents and by mixing accompanied with mild heating, but this is not essential.

It will be understood that the various components of the composition, the essential components as well as the optional and customary components, may react under the conditions of formulation, storage, or use, and that the invention also provides the product obtainable or obtained as a result of any such reaction.

In the following examples, in which all percentages are by weight, certain tests are referred to. They are carried out as follows:

Mack T-8

This test is carried out in an E7-350 six cylinder Mack diesel engine with mechanical fuel injection, the timing being adjusted to give a target level of soot build-up in the lubricant under test. The engine is run at 1800 rpm, at a fuel flow rate of 63.3 kg/hr, for 250 hours. The test evaluates the ability of an oil to retain combustion products, typically soot, in suspension, as demonstrated by reduced viscosity increase and filter plugging when contaminated with a high level of soot. The maximum viscosity increase allowed by the API CG-4 and ACEA E3-96 specifications for one, or the first, test is 11.5 $mm^2$/sec, or cSt, at a soot loading of 3.8%. The maximum allowed increase in pressure differential at that loading is 138 kPa.

Mercedes Benz OM441LA

This test is carried out on a six cylinder diesel engine-with rated performance of 250 kW at 1900 rpm, for 400 hours with 50 hours of full load alternating with 50 hours of cyclic conditions, at an oil sump temperature of 125° C. The engine is subsequently inspected for engine sludge, piston cleanliness, engine and turbo housing deposits, visible engine wear, bore polish, cylinder wear and ring sticking, and the oil consumption is measured. Sludge, cleanliness, deposits and engine wear are evaluated on a merit ratings system, and cylinder wear is measured.

In Example 1, a composition according to the invention was compared with a modern European high power diesel lubricating oil, a 15W40 product meeting the ACEA E3-96 requirement. The oil contained, by weight, 14.8% Paranox 2281 and 8% Paratone 8002 (Trade Marks) providing an antioxidant and an olefin copolymer viscosity modifier) in an Esso base stock.

The composition according to the invention was as follows:

| Component | Function | % |
|---|---|---|
| Hydroisomerized Base Stock (1) | | 44.6 |
| Ester (2) | | 20.0 |
| Hydrogenated Styrene/isoprene Copolymer (3) | Viscosity Modifier | 0.9 |
| Irganox L135 | Hindered Phenolic Antioxidant | 2.0 |
| Amine (4) | Friction Modifier | 0.1 |
| Balance | (5) | 32.4 |

(1) Shell XHVI
(2) Trimethylolpropane ester of mixed $C_8$ to $C_{10}$ alkanoic acids, viscosity at 100° C. 4.5 $mm^2$/s, VI 140, pour point <−42° C., acid value 0.1 mg KOH/g. (Radialube (TM) 7368)
(3) ASTM D445 viscosity of a 6% solution in mineral oil: 1400 $mm^2$/s at 100° C.
(4) N-(2-hydroxyethyl)-N-(3-tallowoxypropyl)-2-aminoethanol
(5) Dispersant, ashless and metal detergent, antiwear agent, flow improver, corrosion inhibitor, other antioxidant, antifoam and diluents.

The composition had a viscosity at 100° C. of 12 $mm^2$/sec, VI of 175, TBN of 15.3 and an ash content of 1.9% by weight.

EXAMPLE 1

The composition according to the invention and the comparison oil were subjected to the Mack T-8 test to establish their soot handling abilities; a low viscosity increase and low change in filter pressure indicate good handling properties. The table shows the results.

| | Composition of Invention | Comparison Oil | Pass* Value |
|---|---|---|---|
| Viscosity Increase at 3.8% soot, $mm^2$/s | 3.2 | 9.3 | 11.5 |
| Increase in Differential Filter Pressure kPa | 17 | 40 | 138.0 |

*ACEA E3-96 pass values (maximum).

EXAMPLE 2

The composition of the invention, as set out above, was subjected to the OM441LA test, and its performance measured against the Mercedes Benz Page 228.5 specification requirements. The results shown in the table establish that all criteria are met.

| Item Rated | Target | Item Result |
|---|---|---|
| Cleanliness, Engine | 9.0 min | 9.4 |
| Cleanliness, Piston | 40 min | 40 |
| Deposits, % | 2.0 max | 1.5 |
| Wear, Visual | 2.5 max | 2.1 |
| Bore polish | 2.0% max | 0.3% |
| Cylinder Wear, mm | 0.008 max | 0.002 |
| Ring sticking (2nd ring) | 1 max | 0 |
| Oil Consumption, g/h | 100 max | 67.7 |

What is claimed is:

1. A lubricant composition comprising an amine-based friction modifier and an ester effective to improve the ability of the lubricant composition to retain particulate combustion products in suspension, the ester being an ester of a carboxylic acid having at most 30 carbon atoms and an alcohol, the ester being substantially free from unreacted alcohol moieties and having a molecular weight within the range of from 400 to 5000, the composition comprising from 5 to 50% by weight of the ester, based on the total weight of the composition.

2. The composition as claimed in claim 1, wherein the molecular weight of the ester is at least 450.

3. The composition as claimed in claim 1, which is a crankcase lubricant.

4. A method of improving the friction-reducing properties of a lubricant composition, the method comprising adding to the lubricant composition an amine-based friction modifier and from 5 to 50% by weight, based on the total weight of the composition, of an ester effective to improve the ability of the lubricant composition to retain particulate combustion products in suspension, the ester being an eater of a carboxylic acid having at most 30 carbon atoms and an alcohol, the ester being substantially free from unreacted alcohol moieties and having a molecular weight within the range of from 400 to 5000.

5. The method as claimed in claim 4, wherein the composition contains from 10 to 40% by weight of the ester, based on the total weight of the composition.

6. The method as claimed in claim 4, wherein the lubricant is a crankcase lubricant.

7. The method as claimed in claim 4, wherein the friction modifier is a tertiary amine.

8. The method as claimed in claim 7, wherein the friction modifier is a compound of a formula

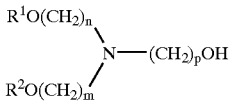

wherein $R^1$ represents an alkyl group, $R^2$ represents an alkyl group or hydrogen, and m, n, and p independently represents an integer within the range of from 1 to 4.

9. A lubricant composition comprising a base lubricant and an amount of an ester of a carboxylic acid having at most 30 carbon atoms and an alcohol effective to improve the ability of the lubricant composition to retain particulate combustion products in suspension, the ester being substantially free from unreacted alcohol moieties and having a molecular weight within the range of from 400 to 5000, an alkenyl arene/diene copolymer viscosity modifier, and a hindered phenol antioxidant, the composition containing from 5 to 50% by weight of the ester, based on the total weight of the composition.

10. A method of improving the effectiveness of a lubricant in controlling piston deposits resulting from particulate products of fuel combustion in a compression-ignited engine, which comprises adding to the lubricant composition an ester of a carboxylic acid having at most 30 carbon atoms and an alcohol effective to improve the ability of the lubricant composition to retain said particulate products of fuel consumption in suspension, the eater having a molecular weight within the range of from 400 to 5000, an alkenyl arene/diene copolymer viscosity modifier, and a hindered phenol antioxidant, the composition containing from 5 to 50% by weight of the ester, based on the total weight of the composition.

11. The method as claimed in claim 10, wherein the viscosity modifier is a hydrogenated block copolymer of styrene and isoprene, or a hydrogenated star polymer.

12. The method as claimed in claim 10, wherein the viscosity modifier is a hydrogenated styrene/isoprene copolymer having a weight average molecular weight in the range of from 70000 to 100000.

13. The method as claimed in claim 10, wherein the hindered phenol antioxidant is of the formula

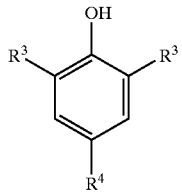

wherein $R^3$ represents a tertiary butyl group, and $R^4$ represents an alkyl group, optionally interrupted by a hetero atom, $CH_2$-aryl, or $(CH_2)_n$ $COOR^5$, in which n represents 1 to 4 and $R^5$ represents an alkyl group.

14. The method as claimed in claim 10, wherein the composition also comprises an amine-based friction modifier.

* * * * *

UNITED STATES PATENT AND TRADEMARK OFFICE

CERTIFICATE OF CORRECTION

PATENT NO. : 6,844,301 B2
APPLICATION NO. : 10/235466
DATED : January 18, 2005
INVENTOR(S) : Field et al.

It is certified that error appears in the above-identified patent and that said Letters Patent is hereby corrected as shown below:

Column 4
Line 14, "0.15% ," should read --0.15%,--.

Column 5
Line 15, "15%" should read --1.5%--.

Column 6
Line 35, "R2" should read --$R^2$--.

Column 7
Line 51, "engine-with" should read --engine with--.

Column 10
Line 12, "the eater" should read --the ester--.

Signed and Sealed this

Twenty-fifth Day of December, 2007

JON W. DUDAS
*Director of the United States Patent and Trademark Office*